United States Patent [19]

Da Costa

[11] Patent Number: 4,978,287

[45] Date of Patent: Dec. 18, 1990

[54] HORIZONTAL CRANKSHAFT ROTARY COMPRESSOR WITH OIL DRAIN TUBE FROM MUFFLER TO INTERIOR OF SHELL

[75] Inventor: Caio M. F. N. Da Costa, Joinville, Brazil

[73] Assignee: Empresa Brasileira de Compressores, Joinville, Brazil

[21] Appl. No.: 394,359

[22] Filed: Aug. 15, 1989

[30] Foreign Application Priority Data

Sep. 21, 1988 [BR] Brazil ..... PI8804948

[51] Int. Cl.[5] ..... F04C 29/06; F04C 29/02

[52] U.S. Cl. ..... 418/96; 418/181

[58] Field of Search ..... 418/95, 96, DIG. 1, 418/63, 181

[56] References Cited

U.S. PATENT DOCUMENTS 3,040,974 6/1962 Langdon ..... 418/DIG. 1

4,457,671 7/1984 Watanabe ..... 418/181

*Primary Examiner*—John J. Vrablik

*Assistant Examiner*—David L. Cavanaugh

*Attorney, Agent, or Firm*—Darby & Darby

[57] ABSTRACT

A horizontal crankshaft rotary compressor in a housing having a discharge muffler formed with a plurality of interconnected communicating volumes with a discharge tube extending through the housing in which an oil draining tube has one end communicating with the lowest muffler volume where oil accumulates and the other end with the interior of the shell at a point above the oil in the bottom of the housing.

6 Claims, 1 Drawing Sheet

HORIZONTAL CRANKSHAFT ROTARY COMPRESSOR WITH OIL DRAIN TUBE FROM MUFFLER TO INTERIOR OF SHELL

BACKGROUND OF THE INVENTION

The present invention relates to a rotary piston compressor with horizontal crankshaft, and more specifically to an improvement on its muffler chamber.

The discharge muffler chamber of rotary compressors is usually made up of a certain number of volumes arranged in series and/or parallel, where the pulsations of the discharge gas flow are muffled.

In the discharge through the compressor discharge valve, gas is discharged together with some oil quantity as is typical of rotary compressors. This oil, mostly due to its greater density and viscosity, does not follow the gas flow through the muffler chamber volumes, and ends up by being contained in the chamber till a certain stable level is reached. This can cause several disfunctions, which are:

1—Alteration of the muffler chamber effective volumes and, therefore, alternation of its attenuation characteristic.

2—Since the discharge valve orifice is at a high temperature, as well as the whole muffler chamber, any delay of the passage of oil from these points will increase the its temperature. This has a negative effect upon the compressor efficiency.

Therefore, the oil accumulation and its prolonged contact with the muffler chamber must be avoided in order to keep the oil temperature from increasing.

3—The impact and cavitation noise of the discharge valve reed is obliged to work covered by oil and its efficiency is decreased.

A known arrangement for reducing the oil quantity retained in the interior of the muffler chamber of a horizontal crankshaft rotary compressor is that one proposed by U.S. Pat. No. 4,636,154. In this arrangement, the oil is purged by means of a hole at the center of the muffler chamber, and is conducted up to this hole through channels which direct the discharge flow from its first volume. In spite of contributing for the process of purging the oil, the solution described on U.S. Pat. No. 4,636,154 has the following inconveniences:

The course of the oil flow from the outlet of the first volume of the muffler chamber is not effective enough to avoid oil accumulation at the lowest level of the first volume; the said first level is very near and can be in contact with the discharge valve orifice, thereby causing all problems related to oil heating and noise previously described;

The hole at the center of the muffler chamber for oil discharge may alter the characteristic of its noise attenuation.

OBJECT OF THE INVENTION

It is an object of the present invention to provide a compressor with horizontal crankshaft with an oil draining system for the discharge muffler chamber which is of simple assembly and production, low cost and able to overcome the deficiencies of the solutions known.

BRIEF DESCRIPTION OF THE INVENTION

The horizontal crankshaft rotary compressor of the invention includes a hermetic shell for housing a set of a cylinder and rotating piston the discharge volume of the cylinder is in communication through the discharge valve, with the first volume of the discharge muffler chamber which is provided with a plurality of hermetic volumes interconnected among themselves. The last muffler volume is put in direct or indirect fluid communication with a discharge tube arranged through the shell outer wall, so that the bottom of the last muffler volume defines the lubricant oil sump of the compressor.

According to the invention, an oil draining tube with a diameter considerably smaller than the discharge connector is arranged through one of the external walls of the discharge muffler chamber and has one of its ends open to the most interior part of the first volume. The other tube ending is open to the interior of the housing shell at a point placed above the lubricant oil level at the bottom of the said shell.

The oil ejection through the draining tube occurs because the pressure in the interior of the muffler chamber is higher than that in the interior of the compressor shell.

The oil draining system as above described is advantageous in that does not allow oil accumulation at the low part of the first volume of the discharge muffler chamber avoiding, therefore, the problems previously described.

Moreover, since the drainage is through a tube with a certain length continuously draining only oil, and not oil and gas through a simple hole as it was in the prior art, this avoids the adverse effect on the noise attenuation characteristics of the discharge muffler chamber.

Besides that, due to its length, the draining tube will operate as an acoustic filter if by chance any gas flow occurs through it.

In the prior art, the flow through the orifice is of gas and oil, changing the characteristics of the muffler chamber. In the case of the present invention, the flow through the tube will be, at normal function conditions, only of oil and not of gas with which the proper conditions of the muffler chamber are maintained.

BRIEF DESCRIPTION OF THE DRAWING

The invention will be described as follows making reference to the accompanying drawings, wherein.

DETAILED DESCRIPTION OF THE INVENTION

Figure 2:
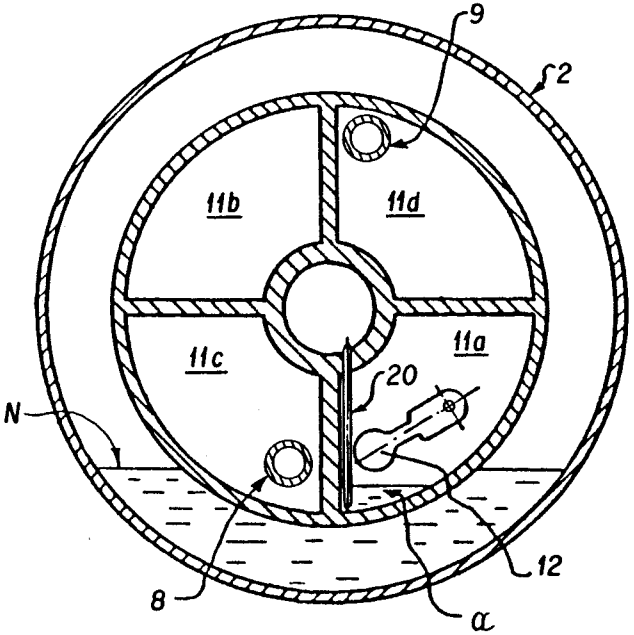
FIG. 2 is a cross sectional view taken according to line 11—11 of FIG. 1 where the front wall of the discharge muffler chamber has been cut away in order to give a better visualization of the placement.

According to the illustrations above, the rotary compressor includes a hermetic shell 1 having front end wall or cover 2 and housing a set of cylinder 3 and rotating piston 4. This piston is mounted on a shaft 5 driven by an electric motor 6 and having an end supported by at least a main bearing 7.

The end cover 2 is provided with a suction tube 8 and a discharge tube 9. The suction tube 8 is in communication with the cylinder 3 suction volume, while the discharge tube 9 is connected to a discharge muffler chamber 10 mounted against the end wall of the cylinder 3.

The discharge muffler chamber 10, as shown in FIG. 2, if formed by a plurality of hermetic volumes 11*a* to 11*d* interconnected in series and/or in parallel. The first volume 11*a* is connected to the discharge volume of the cylinder 3 through a discharge valve 12 of known constructions, arranged in a gas inlet orifice 12*a* of the end wall of the muffler chamber 10 adjacent to the cylinder 3. The last volume 11*d* of the muffler chamber 10 is connected to the discharge tube 9 through the muffler gas outlet orifice 12*b*.

Figure 1:
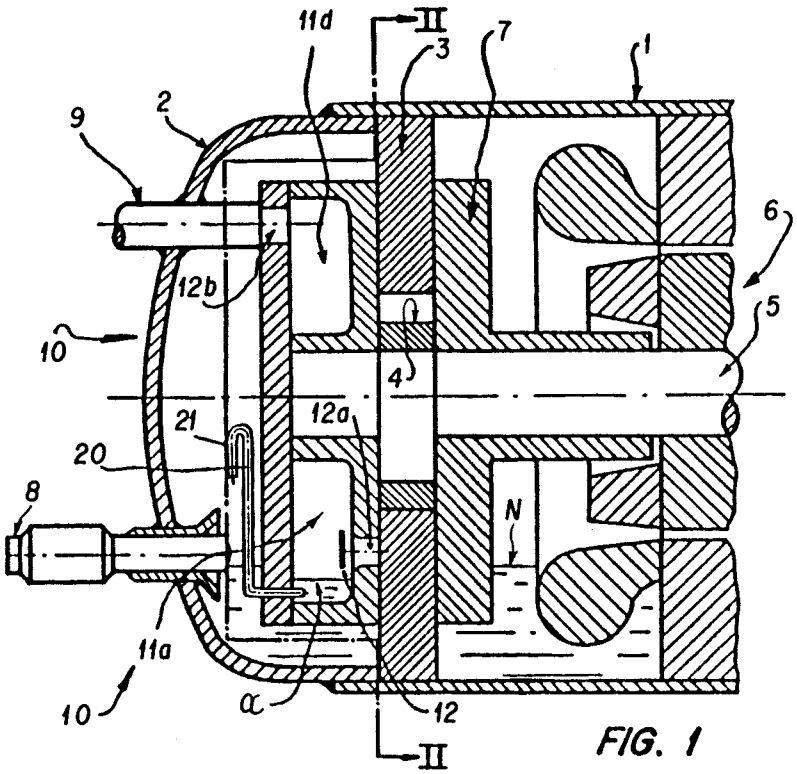
FIG. 1 represents longitudinal sectional view of a horizontal crankshaft rotary compressor showing the oil draining system of the present invention.

As illustrated in FIG. 1, the bottom of the hermetic shell 1 defines a sump to the compressor lubricant oil, which is maintained at a level N.

To withdraw the lubricant oil LO that accumulates at the lower interior part of the first volume 11*a* of the muffler chamber 10, a draining tube 20, of reduced diameter as provided having one end located at the lower part of the first volume 11*a* and the opposite end to the interior of the shell 1 at a point above the level N of the stored lubricant oil, is provided.

The oil draining tube 20 passes through the outer wall of the muffler chamber 10, being preferably fastened to this wall and provided with a downwards curve 21 on its upper end which is open to the interior of the hermetic shell 1.

As it can be observed, the diameter of the draining tube 20 is considerably smaller in relation to the discharge 9 and suction 8 tubes, being dimensioned to allow that only oil LO, which tends to accumulate at the bottom of the first volume 11*a* of the muffler chamber 10, be continuously and progressively forced through the draining tube 20, to drain off towards the volume of the stored oil at the bottom of the shell. In the preferred embodiment illustrated, the draining tube 20 is a capillary type tube.

As previously mentioned, the oil ejection through the draining tube 20 occurs due to the pressure differential between the interior of the muffler chamber 10 and the interior of the shell 1.

I claim:

1. A horizontal crankshaft rotary compressor which is oil lubricated comprising:

a housing, a motor compressor set within said housing, said compressor having a cylinder with a discharge volume and a discharge valve therefore, said housing serving as a sump for the oil, a discharge muffler in communication with the cylinder discharge volume through the discharge valve, an oil draining tube having one end in communication with the muffler interior at a point where oil can accumulate and the other end in the housing at a point above the oil level in the sump.

2. The compressor of claim 1 wherein said one end of the oil draining tube passes through a wall of the muffler.

3. The compressor of claim 2 wherein the muffler has a plurality of interconnected chambers, said one end of the oil draining tube extending into the lowermost chamber at a lower part thereof.

4. The compressor of claim 1 further comprising a discharge tube from the discharge muffler passing through the housing to provide communication between the muffler and the exterior to the housing.

5. The compressor of claim 4 wherein the diameter of the oil draining tube is smaller than that of the discharge tube.

6. The compressor of claim 5 wherein said oil draining tube is a capillary tube.

* * * * *

UNITED STATES PATENT AND TRADEMARK OFFICE

CERTIFICATE OF CORRECTION

PATENT NO. : 4,978,287

DATED : December 18, 1990

INVENTOR(S) : Caio M. F. N. Da Costa

It is certified that error appears in the above-identified patent and that said Letters Patent is hereby corrected as shown below:

On the Title page change the Assignee's name from "Empresa Brasileira de Compressores"

to --Empresa Brasileira de Compressores S/A - EMBRACO--.

Signed and Sealed this

Twenty-sixth Day of January, 1993

*Attest:*

STEPHEN G. KUNIN

*Attesting Officer*

*Acting Commissioner of Patents and Trademarks*